US008459963B2

(12) United States Patent
Pileski

(10) Patent No.: US 8,459,963 B2
(45) Date of Patent: Jun. 11, 2013

(54) SCREW COMPRESSOR PULSATION DAMPER

(75) Inventor: Peter J. Pileski, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 488 days.

(21) Appl. No.: 12/678,338

(22) PCT Filed: Oct. 10, 2007

(86) PCT No.: PCT/US2007/021646

§ 371 (c)(1),
(2), (4) Date: Mar. 16, 2010

(87) PCT Pub. No.: WO2009/048447

PCT Pub. Date: Apr. 16, 2009

(65) Prior Publication Data

US 2010/0202904 A1 Aug. 12, 2010

(51) Int. Cl.
*F04B 49/00* (2006.01)
*F04B 39/00* (2006.01)

(52) U.S. Cl.
USPC ..... 417/312; 418/201.2

(58) Field of Classification Search
USPC ..... 417/310, 438, 443, 447; 418/201.2, 418/201.3
See application file for complete search history.

(56) References Cited

U.S. PATENT DOCUMENTS 2,519,913 A 8/1950 Lysholm
3,146,720 A 9/1964 Henry
3,151,806 A 10/1964 Whitfield
3,874,828 A 4/1975 Herschler et al.
3,936,239 A 2/1976 Shaw
4,018,583 A 4/1977 Patnode et al.
4,025,244 A * 5/1977 Sato ..... 418/87
4,042,310 A 8/1977 Schibbye et al.
4,076,461 A 2/1978 Moody, Jr. et al.
4,137,018 A 1/1979 Brucken
4,222,716 A 9/1980 Shaw
4,234,296 A 11/1980 Matsubara et al.
4,351,160 A 9/1982 Kountz et al.
4,362,472 A 12/1982 Axelsson (Continued)

FOREIGN PATENT DOCUMENTS

EP 0175354 3/1986
EP 1553300 A1 7/2005

(Continued)

OTHER PUBLICATIONS

T. Nares, et al., "Reducing Noise Levels and Sound Transmission in Refrigeration Systems Using High Speed, Gear Driven Screw Compressors", Oct. 22, 1996 (p. 1-5).

*Primary Examiner* — Charles Freay
(74) *Attorney, Agent, or Firm* — Cantor Colburn LLP

(57) ABSTRACT

A slide valve for use in a screw compressor comprises a main body portion configured for sliding in a pressure pocket of a screw compressor to regulate output of a working matter through screw rotors of the compressor. The main body of the slide valve includes a plurality of walls that define an enclosed interior cavity. The slide valve also includes a bore extending into a wall of the main body such that working matter discharged from the screw rotors has access to the enclosed interior cavity. The bore is sized to dampen pressure pulsations in the discharged working matter as the discharged working matter flows through the bore.

14 Claims, 4 Drawing Sheets

U.S. PATENT DOCUMENTS

| | | | |
|---|---|---|---|
| 4,373,866 | A | 2/1983 | Zimmern |
| 4,388,048 | A | 6/1983 | Shaw et al. |
| 4,455,131 | A | 6/1984 | Werner-Larsen |
| 4,457,681 | A | 7/1984 | Garland |
| 4,508,491 | A | 4/1985 | Schaefer |
| 4,516,914 | A | 5/1985 | Murphy et al. |
| 4,519,748 | A | 5/1985 | Murphy et al. |
| 4,565,508 | A | 1/1986 | Lindstrom |
| 4,575,323 | A | 3/1986 | Yoshimura |
| 4,678,406 | A | 7/1987 | Pillis et al. |
| 4,737,082 | A | 4/1988 | Glanvall |
| 4,842,501 | A | 6/1989 | Schibbye et al. |
| 4,878,818 | A | 11/1989 | Shaw |
| 4,909,716 | A | 3/1990 | Orosz et al. |
| 4,946,362 | A | 8/1990 | Soderlund et al. |
| 4,966,531 | A | 10/1990 | Suzuki et al. |
| 5,018,948 | A | 5/1991 | Sjöholm et al. |
| 5,044,894 | A | 9/1991 | Field et al. |
| 5,052,901 | A | 10/1991 | Englund |
| 5,108,269 | A | 4/1992 | Glanvall |
| 5,123,822 | A | 6/1992 | Yoshimura |
| 5,183,395 | A | 2/1993 | Langouet |
| 5,411,387 | A | 5/1995 | Lundin et al. |
| 5,832,737 | A | 11/1998 | Moilanen |
| 5,979,168 | A | 11/1999 | Beekman |
| 6,135,744 | A | 10/2000 | Andersen et al. |
| 6,195,889 | B1 | 3/2001 | Gannaway |
| 6,302,668 | B1 | 10/2001 | Lee |
| 6,312,232 | B1 | 11/2001 | Mori et al. |
| 6,467,287 | B2 | 10/2002 | Sjoholm et al. |
| 6,638,043 | B1 | 10/2003 | Holden |
| 6,659,729 | B2 | 12/2003 | Hattori et al. |
| 6,692,243 | B1 | 2/2004 | Rousseau |
| 6,739,853 | B1 | 5/2004 | Tang et al. |
| 6,823,896 | B2 | 11/2004 | Hong |
| 6,898,948 | B2 * | 5/2005 | Roelke et al. ..... 62/505 |
| 6,976,833 | B2 | 12/2005 | Daniels et al. |
| 7,069,741 | B2 | 7/2006 | Sishtla |
| RE39,597 | E | 5/2007 | Rousseau |
| 2006/0127235 | A1 | 6/2006 | Shoulders |
| 2006/0165543 | A1 | 7/2006 | Fox et al. |

FOREIGN PATENT DOCUMENTS

| | | |
|---|---|---|
| JP | 58088484 | 5/1983 |
| JP | 2001289184 | 10/2001 |
| JP | 2004043883 | 2/2004 |
| JP | 2005030362 | 2/2005 |
| WO | WO 2004053334 A1 | 6/2004 |
| WO | WO 2006096178 A1 | 9/2006 |

* cited by examiner

SCREW COMPRESSOR PULSATION DAMPER

BACKGROUND

The present invention relates generally to screw compressors. Screw compressors typically comprise a pair of counter-rotating, mating male and female screws that have an intermeshing plurality of lands and channels, respectively, that narrow from an inlet end to a discharge end such that an effluent working fluid or gas, or some other such working matter, is reduced in volume as it is pushed through the screws. The discharged working matter is released in pulses as each mating land and channel pushes a volume of the working matter out of the compressor. Each pulse comprises a burst of wave energy that propagates through the working matter and the screw compressor as the working matter decompresses. The screw compressors are typically turned by motors operating at elevated speeds such the wave pulsations are discharged at a high frequency. The pulsations not only produce vibration of the screw compressor, but also produce noise that is amplified by the working matter and the compressor itself. Such vibration is undesirable as it wears components of the compressor and produces additional noise as the compressor vibrates. Noise from the discharging working matter and vibrating compressor is undesirable as it results in loud operating environments. Previous attempts to counteract these problems have involved mufflers, padded mounts and clamps that are mounted external to the screw compressor. These solutions, however, rely on cumbersome add-ons that increase cost, weight and complexity of the screw compressor. Furthermore, these solutions do not address the underlying source of the noise and vibration, but only address the problem after it is produced. There is, therefore, a need for screw compressors having reduced effects from discharge pulsations.

SUMMARY

Exemplary embodiments of the invention include a slide valve for use in a screw compressor. The slide valve comprises a main body portion configured for sliding in a pressure pocket of a screw compressor to regulate output of a working matter through screw rotors of the compressor. The main body of the slide valve includes a plurality of walls that define an enclosed interior cavity. The slide valve also includes a bore extending into a wall of the main body such that working matter discharged from the screw rotors has access to the enclosed interior cavity. The bore is sized to dampen pressure pulsations in the discharged working matter as the discharged working matter flows through the bore.

DETAILED DESCRIPTION

Figure 1:
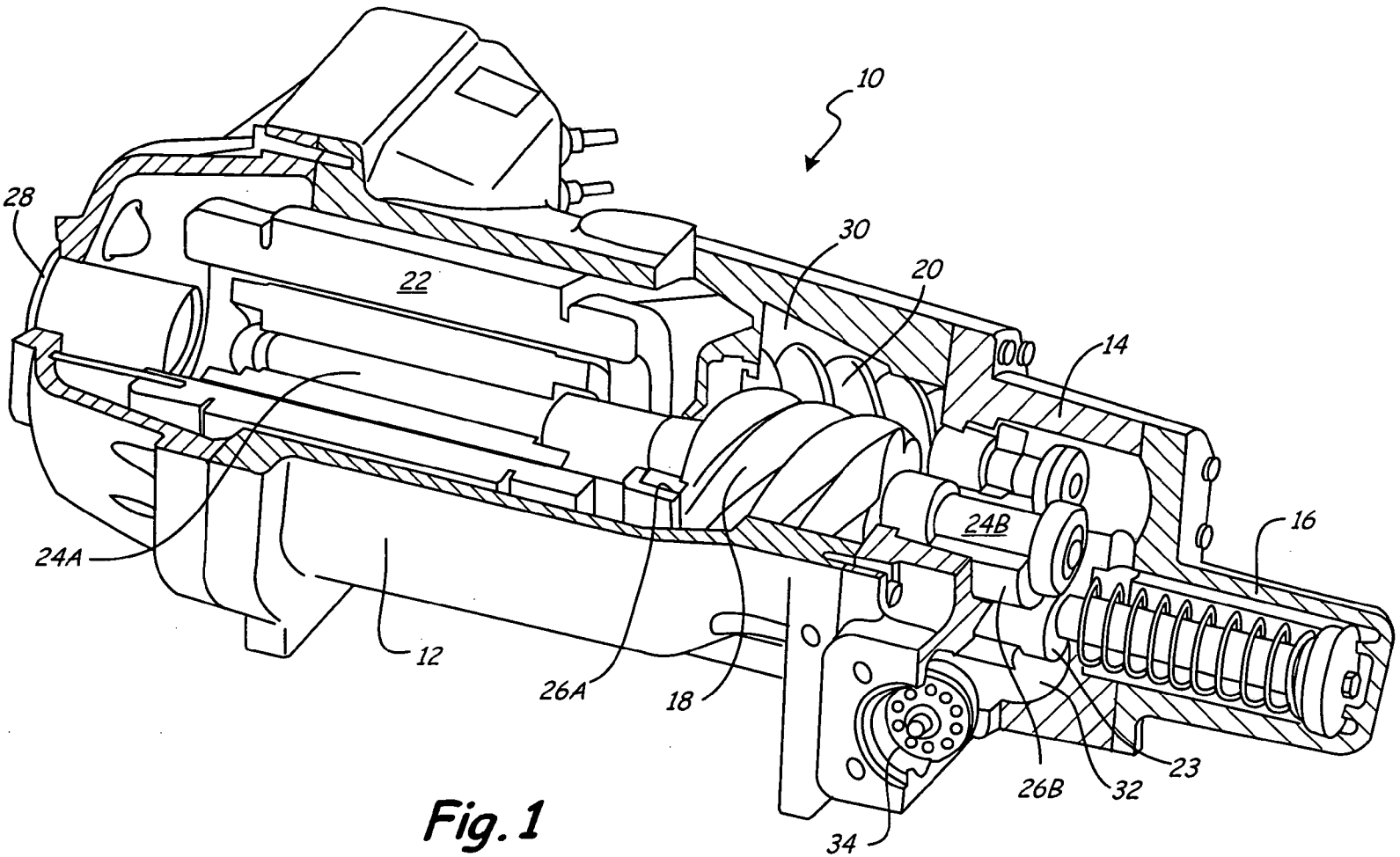
FIG. 1 shows a partially cutaway perspective view of a screw compressor in which the present invention is used.

FIG. 1 shows a partially cutaway perspective view of screw compressor 10, which compresses a working fluid or gas such as a refrigerant that is typically used in refrigeration or air conditioning systems. Screw compressor 10 includes rotor case 12, outlet case 14, slide case 16, male screw rotor 18, female screw rotor 20, drive motor 22 and slide valve 23. Male screw rotor 18 and female screw rotor 20 are disposed within rotor case 12 and include shafting and bearings such that they can be rotationally driven by drive motor 22. For example, male screw rotor 18 includes shaft 24A that extends axially through rotor case 12 and into motor 22 and rests on bearing 26A, and shaft 24B, which extends axially into outlet case 14 and rests in bearing 26B. Refrigerant is introduced into rotor case 12 at suction port 28, directed around motor 22 and into suction pocket 30 at the inlet of screw rotors 18 and 20. Male screw rotor 18 and female screw rotor 20 include meshing grooves and lands that form helical flow paths having decreasing cross sectional areas as the grooves and lands extend from suction pocket 30. Slide valve 23, which is driven by a piston system disposed within slide case 16, translates axially between rotors 18 and 20 to vary the volume of refrigerant compressed in the helical flow paths in order to regulate the discharge capacity of screw compressor 10. Thus, the refrigerant is reduced in volume and pressurized as the refrigerant is directed into pressure pocket 32 before being discharged at pressure port 34 and released to, for example, a condenser or evaporator of a cooling system. Due to the multiple sets of meshing grooves and lands, the refrigerant is discharged into pressure pocket 32 in a series of high frequency pulsations, which effectuates undesirable noise and vibration. Slide valve 23 includes a pulsation damper that mitigates the pulsation effects of the discharged refrigerant. In the embodiment shown, screw compressor 10 comprises a two-screw compressor. However, in other embodiments, the present invention is readily applicable to compressors having three, four our more screw rotors that employ a reciprocating slide valve system.

Figure 2:
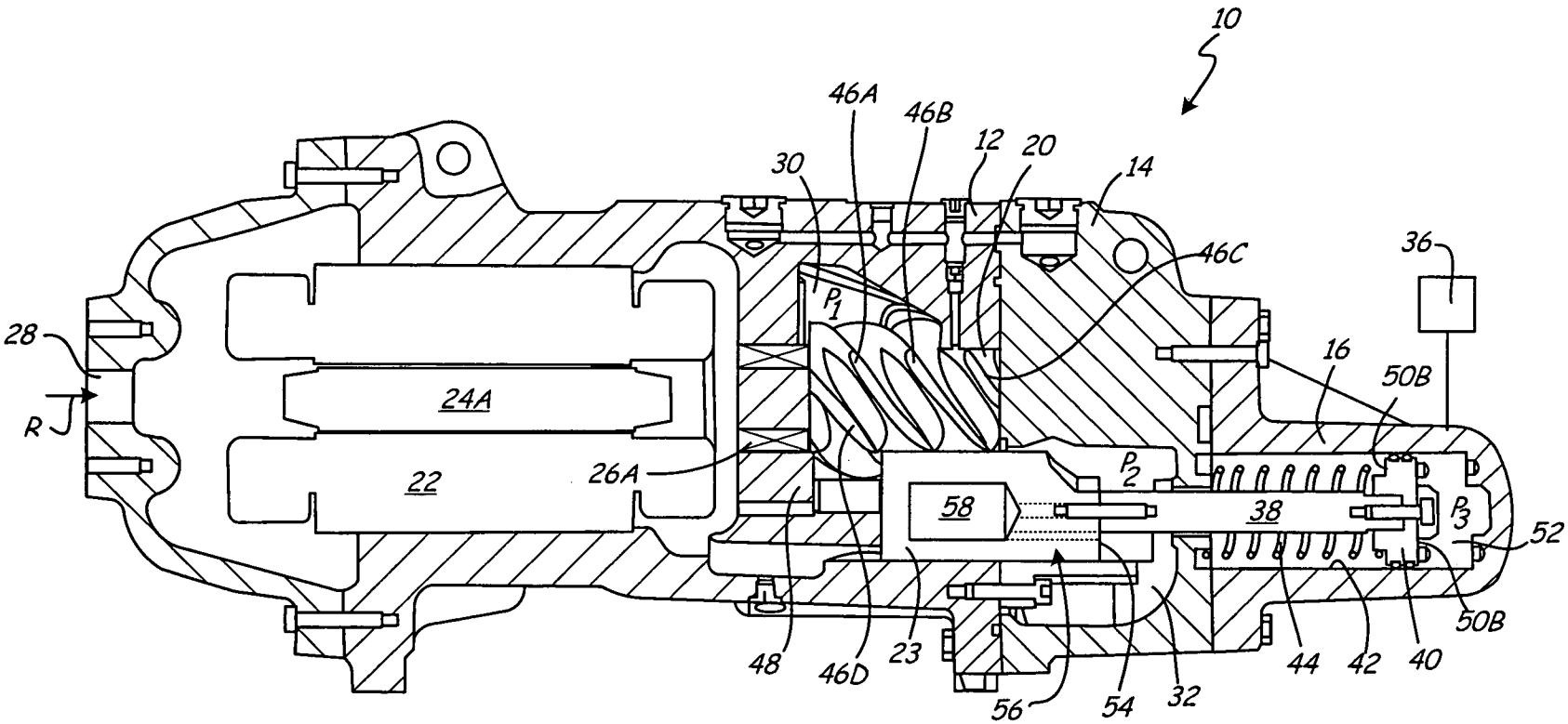
FIG. 2 shows a schematic diagram of the screw compressor of FIG. 1 in which a slide valve having the pulsation damper of the present invention is used.

FIG. 2 shows a schematic diagram of screw compressor 10 of FIG. 1, having slide valve 23 of the present invention. Screw compressor 10 includes rotor case 12, outlet case 14, slide case 16, female screw rotor 20, drive motor 22, slide valve 23, control system 36, slide rod 38, piston 40, cylinder 42 and spring assist 44. Together, rotor case 12, outlet case 14 and slide case 16 comprise a sealed flow path for directing refrigerant R through screw compressor 10. Refrigerant R is directed into rotor case 12 at suction port 28, and routed around motor 22 to suction pocket 30. Male screw rotor 18 (not shown) and female screw rotor 20 compress refrigerant R from suction pocket 30 for discharge into pressure pocket 32. Female screw rotor 20 includes screw channels, or grooves, 46A-46D that mesh with mating lands or lobes on male screw rotor 18 to form a sealed, decreasing-volume flow path. The sealed flow path decreases in volume such that refrigerant R is pushed and compressed as it moves from suction pocket 30 to pressure pocket 32. Accordingly, refrigerant R enters, for example, screw channel 46A at inlet 26 having pressure $P_1$ and is discharged from the same screw channel 46A at pressure pocket 32 having elevated pressure $P_2$. Thus, each screw channel delivers a small volume of refrigerant R to pressure pocket 32. As screw rotors 18 and 20 rotate, a series of discharge pulses of refrigerant R is released to pressure pocket 32, which causes undesirable noise and vibration of screw compressor 10. Slide valve 23, which controls the capacity of screw compressor 10, includes pulsation damper to reduce the noise and vibration effects of refrigerant R as it is discharged from screw rotors 18 and 20.

Slide valve 23 is disposed within a slide recess within pressure pocket 32 and is configured to engage the crevice between male screw rotor 18 and female screw rotor 20. As such, slide valve 23, channels 46A-46D of female rotor 20, the lands of male rotor 18, rotor case 12 and discharge case 14 define a sealed and pressurized flow path for refrigerant R. Slide valve 23 is connected with rod 38 and piston head 40 to axially traverse slide valve 23 within pressure pocket 32. Slide valve 23 translates along screw rotor 20 to vary the volume of refrigerant R entrained within screw channels 46A-46D. For example, when slide valve 23 is extended to the fully-loaded position (to the left in FIG. 1) such that it contacts slide stop 48, the output capacity of screw compressor 10 is increased such as to supply additional amounts of refrigerant R to a refrigerator or air conditioner. Slide valve 23 is moved toward pressure pocket 32 (to the right in FIG. 1) to decrease the discharge capacity of screw compressor 10. Rod 38 connects slide valve 23 to piston head 40, which is disposed within piston cylinder 42. Piston head 40 includes first pressure side 50A, which is exposed to refrigerant R at pressure $P_2$, and second pressure side 50B, which is exposed to piston chamber 52 at pressure $P_3$. Pressure $P_3$ is controlled by control system 36, which comprises switches, valves, solenoids and the like to selectively provide pressure oil to piston chamber 52 to adjust the outflow of refrigerant R based on the loading (i.e. cooling demands) of the refrigerator or air conditioner. The pressure oil within piston chamber 52 exerts a force on second pressure side 50B to move slide valve 23 toward slide stop 48 and the fully-loaded position. To move slide valve 23 away from slide stop 48, pressure $P_3$ is reduced by removing pressure oil from piston chamber 52. Spring assist 44 pushes piston head 40 to the right, which, through rod 38, pulls slide valve 23. Piston head 40 is also in contact with refrigerant R, which exerts pressure $P_2$ on first pressure side 50A to pull slide valve 23 to the right.

Slide valve 23 is directly in contact with refrigerant R as refrigerant R flows through channels 46A-46D of screw rotor 20 and out to pressure pocket 32. Specifically, pressure face 54 of slide valve 23 is very near screw rotor 18 where refrigerant R is discharged into pressure pocket 32. As such, the discharge pulsations of refrigerant R flow past pressure face 54. Pressure face 54 includes pulsation damping channels 56 that permit refrigerant R to enter resonance chamber 58 such that the vibration and noise associated with the discharge of refrigerant R is attenuated.

Figure 3:
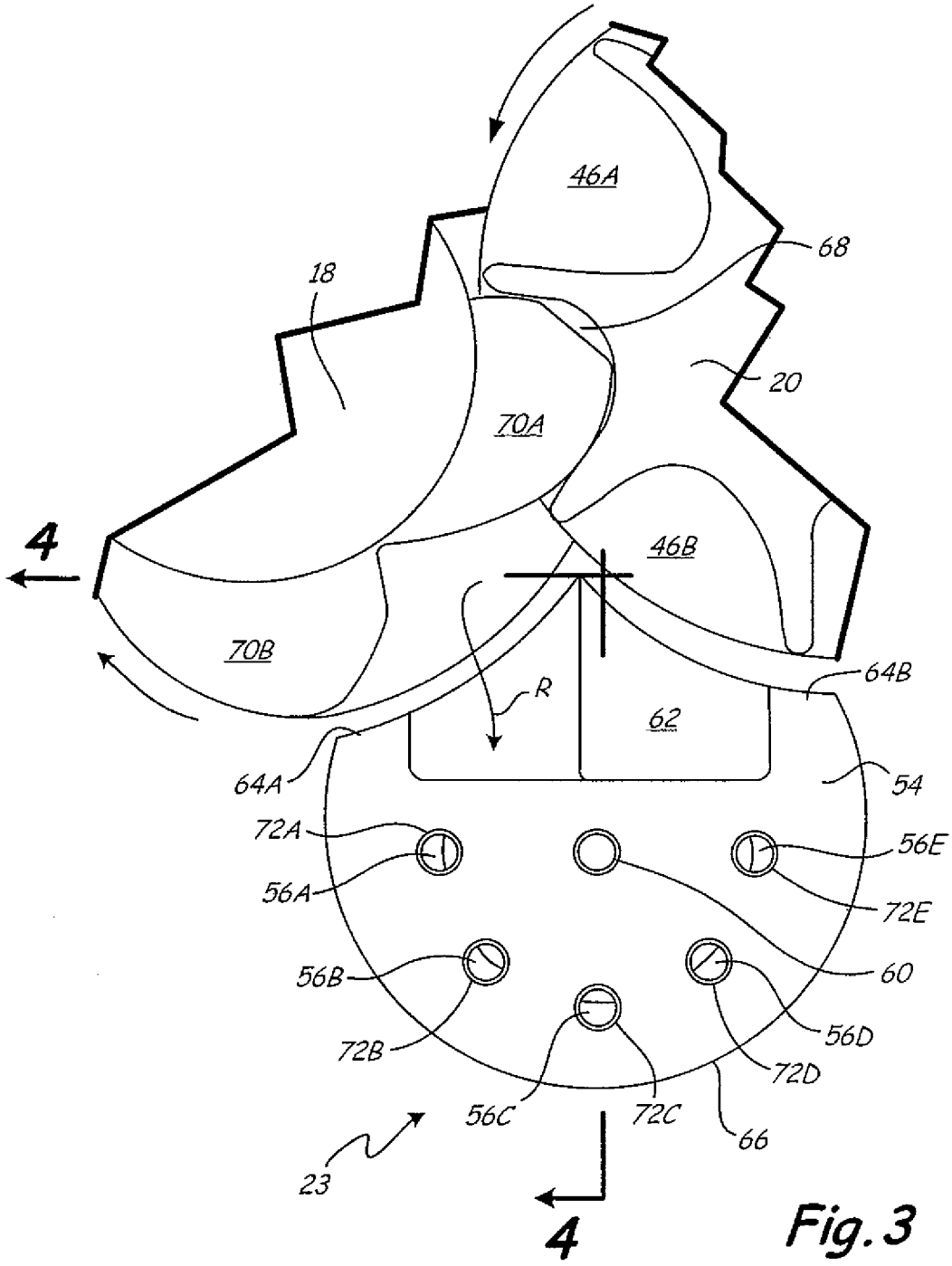
FIG. 3 shows a front view of the slide valve of FIG. 2 nested between screw rotors of the screw compressor.

FIG. 3 shows a front view of slide valve 23 of FIG. 2, in which pulsation damping channels 56A-56E of pressure face 54 are shown. Slide valve 23 also includes actuation interface 60, discharge pocket 62, pressure discharge faces 64A and 64B, and outer surface 66. Pressure discharge faces 64A and 64B of slide valve 23 together comprise a chevron-shaped head on slide valve 23 that seals the flow of refrigerant R along male screw rotor 18 and female screw rotor 20. Slide valve 23 is connected to an actuation device, such as piston rod 38 and piston head 40 of FIG. 2, at interface 60 such that the position of slide valve 23 can be translated to regulate the discharge capacity of refrigerant R from screw rotors 18 and 20. Refrigerant R is compressed in compression pocket 68, which is formed between screw channels 46A and 46B of female screw rotor 20, and screw lands 70A and 70B of male screw rotor 18, respectively. Refrigerant R is released from compression pocket 68 in pulsed discharges into discharge pocket 62 as screw rotors 18 and 20 counter-rotate to open compression pocket 68 to slide valve 23. The pulsed discharges of refrigerant R flow past pressure face 54 before being discharged from screw compressor 10 at pressure port 34 (FIG. 1). Refrigerant R flows into damping channels 56A-56E into internal resonance chamber 58 within slide valve 23. In the embodiment shown, damping channels 56A-56E are fitted with damping tubes 72A-72E, which are explained in greater detail with respect to FIG. 4.

Figure 5:
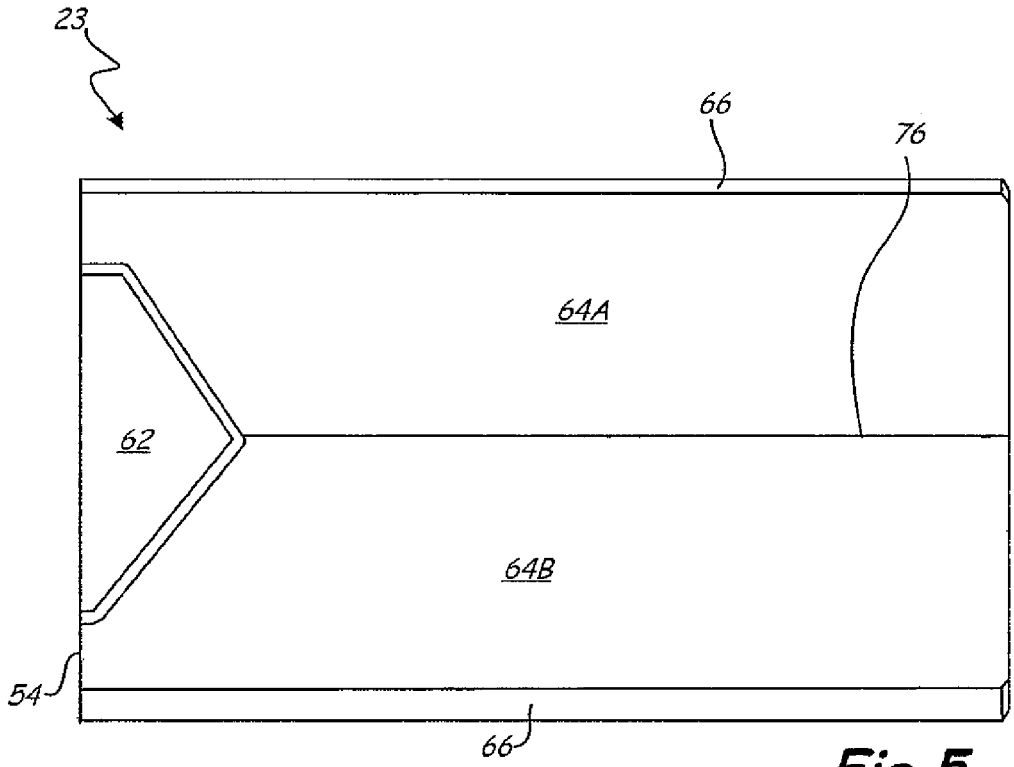
FIG. 5 shows a top view of the slide valve of FIG. 3.
Figure 4:
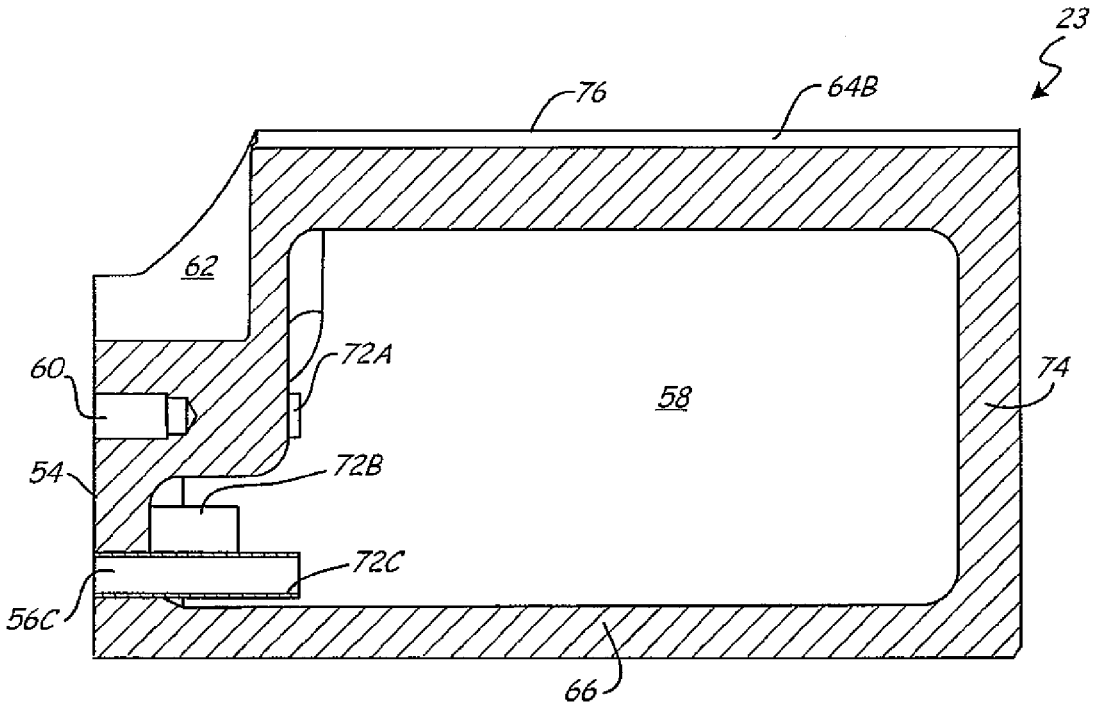
FIG. 4 shows a cross-sectional view of the slide valve of FIG. 3, in which a resonance chamber and damping tubes of the pulsation damper are shown.

FIG. 4 shows a cross-sectional view of slide valve 23 of FIG. 3, in which damping tubes 72A-72C and resonance chamber 58 of the pulsation damper of the present invention are shown. Damping tubes 72A-72E are inserted into damping channels 56A-56E, as is illustrated in FIG. 4 with damping tube 72C being inserted into damping cavity 56C. Damping cavity 56C comprises a hollowed out chamber formed in the interior of slide valve 23. Slide valve 23 comprises a plurality of walls shaped to define a hollow canister having a chevron shaped head formed by pressure discharge faces 64A and 64B, and semi-cylindrical outer surface 66, which are disposed between pressure face 54 and end cap 74. As is shown in FIGS. 4 and 5, pressure discharge faces 64A and 64B come together to define apex 76, which fits between screw rotors 18 and 20. Thus, pressure discharge faces 64A and 64B are arcuate in shape. Pressure discharge faces 64A and 64B merge at the forward end of slide valve 23 to form discharge pocket 62. Discharge pocket 62 comprises an arcuate, triangle shaped surface that forms both an axial and radial discharge port in pressure pocket 32 (FIG. 1). Damping channels 56A-56E are positioned generally below discharge pocket 62 such that refrigerant R after exiting discharge pocket 62, flows past damping channels 56A-56E. Discharge pocket 62 and pressure discharge faces 64A and 64B come together at pressure face 54. Outer surface 66 wraps around pressure face 54 from first pressure discharge face 64A to second pressure discharge face 64B. End cap 74 is disposed between outer surface 66 and pressure discharge faces 64A and 64B to form resonance chamber 58. Thus, resonance chamber 58 is enclosed within the walls of slide valve 23.

Returning to FIG. 4, resonance chamber 58 is accessible within slide valve 23 through damping channels 56A-56E. Damping channels 56A-56E comprise bores extending through pressure face 54 such that refrigerant R is permitted to enter slide valve 23 to pressurize resonance chamber 58 to pressure $P_2$. The lengths of damping channels 56A-56E are determined by the thickness of pressure face 54, but can be altered by inserting damping tubes 72A-72E into damping channels 56A-56E. In one embodiment, damping tubes 72A-72E comprise stainless steel tubes press fit into damping channels 56A-56E. The lengths and diameters of damping tubes 72A-72E and damping channels 56A-56E are selected to influence the acoustics and mechanics of refrigerant R as refrigerant R travels through channels 56A-56E and tubes 72A-72E. Specifically, the length and diameters of damping tubes 72A-72E are selected to extract the maximum amount of energy from refrigerant R.

Refrigerant R is discharged from screw rotors 18 and 20 in pulses at regular intervals having a frequency dictated by the speed at which motor 22 drives screw rotors 18 and 20. These pulses therefore produce undesirable sound waves that increase the noise generated by screw compressor 10. The energy contained in these sound waves, however, can be used to do work to attenuate the propagation of the sound waves from screw compressor 10. Slide valve 23 is configured to function as a Helmholtz resonator, which comprises a container of fluid or gas having a necked opening, such as is produced by refrigerant R, resonance chamber 58 and channels 56A-56E. Refrigerant R fills resonance chamber 58 such that additional refrigerant attempting to enter resonance chamber 58 must compress the volume of refrigerant R already present within resonance chamber 58. Thus, a pulsed wave of refrigerant R attempting to enter resonance chamber 58, compresses refrigerant R until the crest of the wave is reached. Then, the pressurized refrigerant R within resonance chamber 58 will push back as the wave dissipates to the trough. As the pulsed wave propagates through crests and waves, the pressurized refrigerant R within resonance chamber 58 continues to compress and decompress, thus extracting energy from refrigerant R discharged from screw rotors 18 and 20. The energy extraction reduces the amplitude of the pulsation wave, thereby reducing noise and vibration generated by the pulsed discharges of refrigerant R. The position of slide valve 23 is, however, unaffected by the wave pulsations of refrigerant R such that the performance of slide valve 23 is unaffected. The position of slide valve 23 is maintained constant through the rigid connection with piston rod 38 and piston head 40, which is maintained by pressure $P_3$.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A slide valve comprising:

a main body portion configured for sliding in a discharge port of a screw compressor to regulate output of a working matter through screw rotors of the screw compressor; and a pulsation damper carried by the main body to dampen pressure pulsations in the discharged working matter;

wherein the main body portion comprises a plurality of walls to define an enclosed interior cavity, and the pulsation damper comprises a bore extending into a wall of the main body such that working matter discharged from the screw rotors has access to the enclosed interior cavity;

wherein one of the plurality of walls defining the main body comprises a chevron shaped portion designed to fit between the screw rotors of the screw compressor.

2. The slide valve of claim 1 wherein the main body portion includes connection means for joining the slide valve with an actuation mechanism.

3. The slide valve of claim 1 wherein the main body portion includes a discharge pocket for receiving working matter from the screw rotors and directing the working matter out of the screw compressor and past the bore.

4. The slide valve of claim 1 wherein the bore permits working matter discharged from the screw rotors to pressurize the internal cavity.

5. The slide valve of claim 4 wherein the internal cavity is configured so that pressurized working matter within the internal cavity extracts energy from the working matter as the working matter attempts to enter the internal cavity through the bore.

6. The slide valve of claim 1 wherein the bore reduces an amplitude of a sound wave in the working matter as the working matter enters the internal cavity.

7. A slide valve comprising:

a main body portion configured for sliding in a discharge port of a screw compressor to regulate output of a working matter through screw rotors of the screw compressor; and a pulsation damper carried by the main body to dampen pressure pulsations in the discharged working matter;

wherein the main body portion comprises a plurality of walls to define an enclosed interior cavity, and the pulsation damper comprises a bore extending into a wall of the main body such that working matter discharged from the screw rotors has access to the enclosed interior cavity;

wherein the main body includes a plurality of bores extending into the internal cavity.

8. The slide valve of claim 7 wherein the plurality of bores have different lengths to dampen vibrations having different frequencies.

9. The slide valve of claim 7 and further comprising a plurality of tubes inserted into the plurality of bores.

10. A screw compressor comprising:

a housing for receiving a supply of working matter at a suction pocket;

a pair of intermeshing screw rotors disposed within the housing for compressing the working matter and discharging the working matter into a pressure pocket;

a slide valve movable within the pressure pocket between the pair of intermeshing screw rotors to regulate the capacity of the screw compressor; and a pulsation damper carried by the slide valve for damping pressure pulsations in the working matter discharged from the pair of intermeshing screw rotors;

wherein the pulsation damper comprises:

a resonance chamber enclosed within the slide valve between the high pressure end and the low pressure end; and a damping tube extending through the high pressure end of the body to permit the working matter to pressurize the resonance chamber after being discharged from the discharge pocket;

wherein the damping tube reduces an amplitude of the working matter as the working matter enters the resonance chamber;

wherein the high pressure end of the body includes a plurality damping tubes extending into the resonance chamber and an actuation connector positioned concentrically between the plurality of damping tubes at the high pressure end of the body for connecting the slide valve with an actuation mechanism.

11. The screw compressor of claim 10 wherein the slide valve comprises:

a semi-cylindrical body having a high pressure end and a low pressure end;

a chevron shaped pressure head positioned along a side of the body between the high pressure end and the low pressure end, and for nesting between the intermeshing screw rotors; and a discharge pocket positioned at the high pressure end of the body for guiding working matter discharged from the screw rotors into the pressure pocket.

12. The screw compressor of claim 10 wherein the damping tube dampens vibration generated by the working matter.

13. The slide valve of claim 10 wherein the plurality of channels have different lengths.

14. The slide valve of claim 13 wherein the plurality of damping tubes comprise stainless steel inserts press fit into bores positioned on the high pressured end of the body.

* * * * *